United States Patent [19]

Dreier et al.

[11] 4,391,213

[45] Jul. 5, 1983

[54] NEEDLE THREAD GUIDE DEVICE

[75] Inventors: Ernst Dreier, Steckborn; Kurt Spring, Kreuzlingen, both of Switzerland

[73] Assignee: Fritz Gegauf Aktiengesellschaft Bernina-Näehmaschinenfabrik, Steckborn, Switzerland

[21] Appl. No.: 204,281

[22] Filed: Nov. 5, 1980

[51] Int. Cl.[3] ..... D05B 49/02

[52] U.S. Cl. ..... 112/246; 112/221

[58] Field of Search ..... 112/246, 242, 243, 249, 112/221, 158 R, 158 B, 158 E

[56] References Cited

U.S. PATENT DOCUMENTS

| | | | |
|---|---|---|---|
| 978,267 | 12/1910 | Berger | 112/246 |
| 1,048,442 | 12/1912 | Blair | 112/246 X |
| 1,067,293 | 7/1913 | Woodward | 112/246 X |
| 4,315,474 | 2/1982 | Dreier | 112/242 |
| 4,359,954 | 11/1982 | Dreier | 112/221 |

*Primary Examiner*—H. Hampton Hunter

*Attorney, Agent, or Firm*—Birch, Stewart, Kolasch and Birch

[57] ABSTRACT

A needle thread guide device containing an articulated thread feeder oscillating in a vertical plane on a sewing machine provided with a skip stitch mechanism working at intervals to form stitches of varying lengths, wherein a thread catcher is combined with a thread lever which can be engaged and disengaged synchronously with the skip stitch mechanism and which aligns in its operating position with a hook eye open to the top at a position of the upper area of the ascending movement part of the thread lever eye with the latter, thereby catching the thread loop which is carried along by the thread lever.

8 Claims, 7 Drawing Figures

7
10a
9
8
II
II
4
5
4b
1
10b
14a
13
15
4b
14
14b

NEEDLE THREAD GUIDE DEVICE

BACKGROUND AND SUMMARY OF THE INVENTION

The present invention relates to a needle thread guide device with a vertically oscillating thread lever in a sewing machine provided with a skip stitch mechanism which works at intervals. More particularly the present invention is directed to a needle thread guide device on a sewing machine with a skip stitch mechanism working at intervals for forming stitches with varying lengths, utilizing a continuously driven, vertically oscillating thread lever.

Sewing machines of the general type described above are known. The thread lever and its eye, usually driven by a crank, oscillate in time with the needle shaft drive in a vertical plane along a closed curve with an upper and lower reversal point. Its needle shaft is controlled to produce stitches with varying lengths at intervals so that stitch formation is suspended. During the skip stitch interval, i.e. when the stitch formation and thread use are suspended, the thread lever continues to perform its function of supplying the necessary length of thread needed to form a stitch. A relatively large thread reserve is built up during each skip stitch interval between the thread tensor and the needle. The thread does pass through the thread lever eye but otherwise forms a completely free, i.e. slade thread loop. This is particularly true in those situations in which the skip stitch mechanism temporarily disengages the needle shaft from the drive device when the stitch is skipped and holds it stationary in its upper end position. The thread loop formed in this case does not remain still despite the fact that the needle stands still while the thread lever continues to run and can, in unfortunate situations, become tangled around parts of the machine, or both parts of the thread can become entangled.

Accordingly an object of the present invention is to avoid these disadvantages by providing that the excessive length of thread produced by skipping a stitch, in which the thread lever continues to feed in thread during its first empty stroke and forms this thread loop between the needle eye and the thread tensor, is held nearly taut, at least long enough for the normal thread consumption required by normal stitch formation to be initiated again.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

To this end, the needle thread guide device according to the present invention is characterized by a thread lever having a thread catcher which can be engaged and disengaged synchronously with the skip stitch mechanism and which, in its operating position, aligns with a hook eye, open at the top, at a position in the upper area of the upward path of the thread feeder eye, in order to take up the thread loop carried along by the thread lever. The thread lever then continues moving downward without the thread, i.e. the latter remains nearly taut between the thread catcher and the needle. The thread catcher hook is constricted so that when the thread lever subsequently moves upward, the thread lever eye moves up beyond the hook eye of the thread catcher to the upper reversal point picking the thread up in the process and removing it from the hook eye in order to replace it in the catcher hook of the thread catcher with the next downward movement of the thread lever, provided of course, that the thread lever remains in its operating position as a result of the corresponding position of the skip stitch mechanism. Of course the thread catcher is disengaged at any point along the thread lever path at which the thread is removed from the thread catcher.

The thread catcher is advantageously a double lever which pivots around a stationary axis in a plane parallel to the pivoted plane of the thread lever, the latter being operationally connected under spring tension to a lever. Said lever activates the skip stitch mechanism and can be activated in turn by a control device which determines the skip stitch interval. This device can be a cam, a step motor, or any other suitable interval control device.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
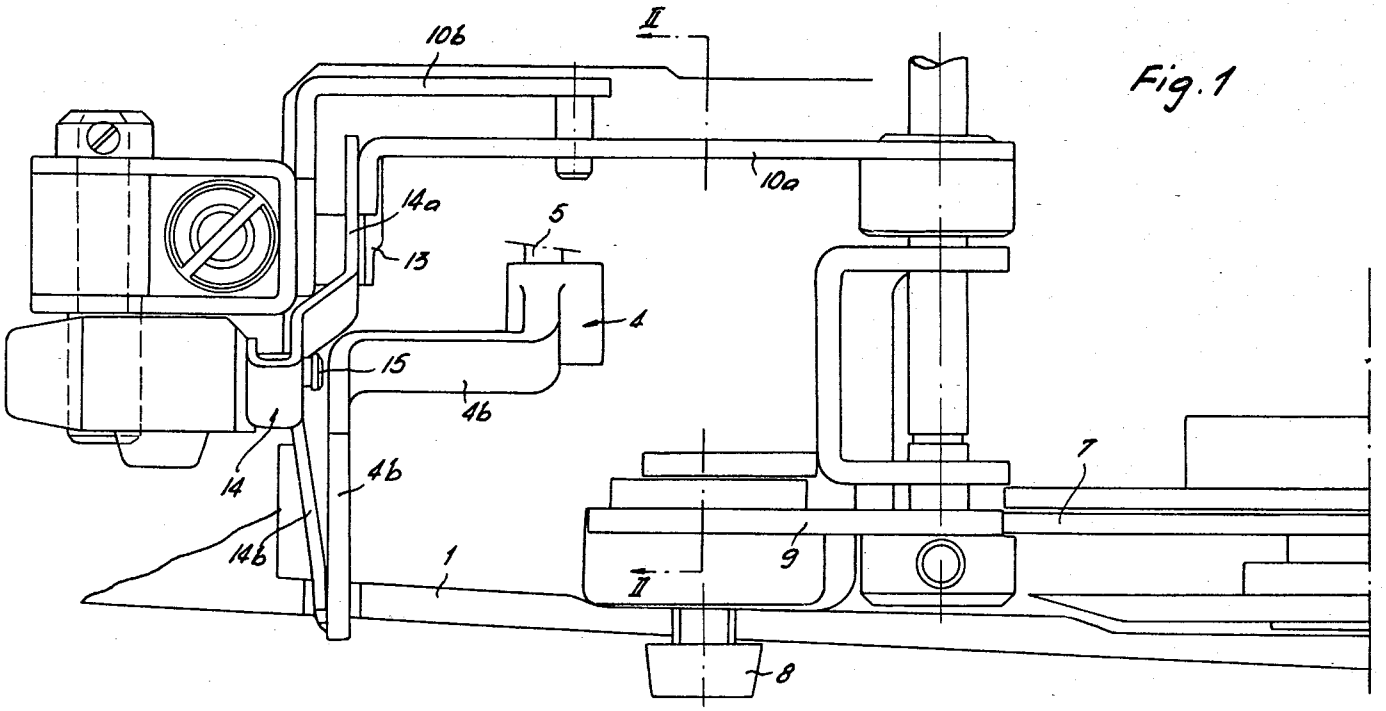
FIG. 1 shows a top view of a needle thread guide device on a sewing machine with a thread feeder lever, a thread catcher interval control cam for a thread catcher and a skip stitch mechanism.
Figure 2:
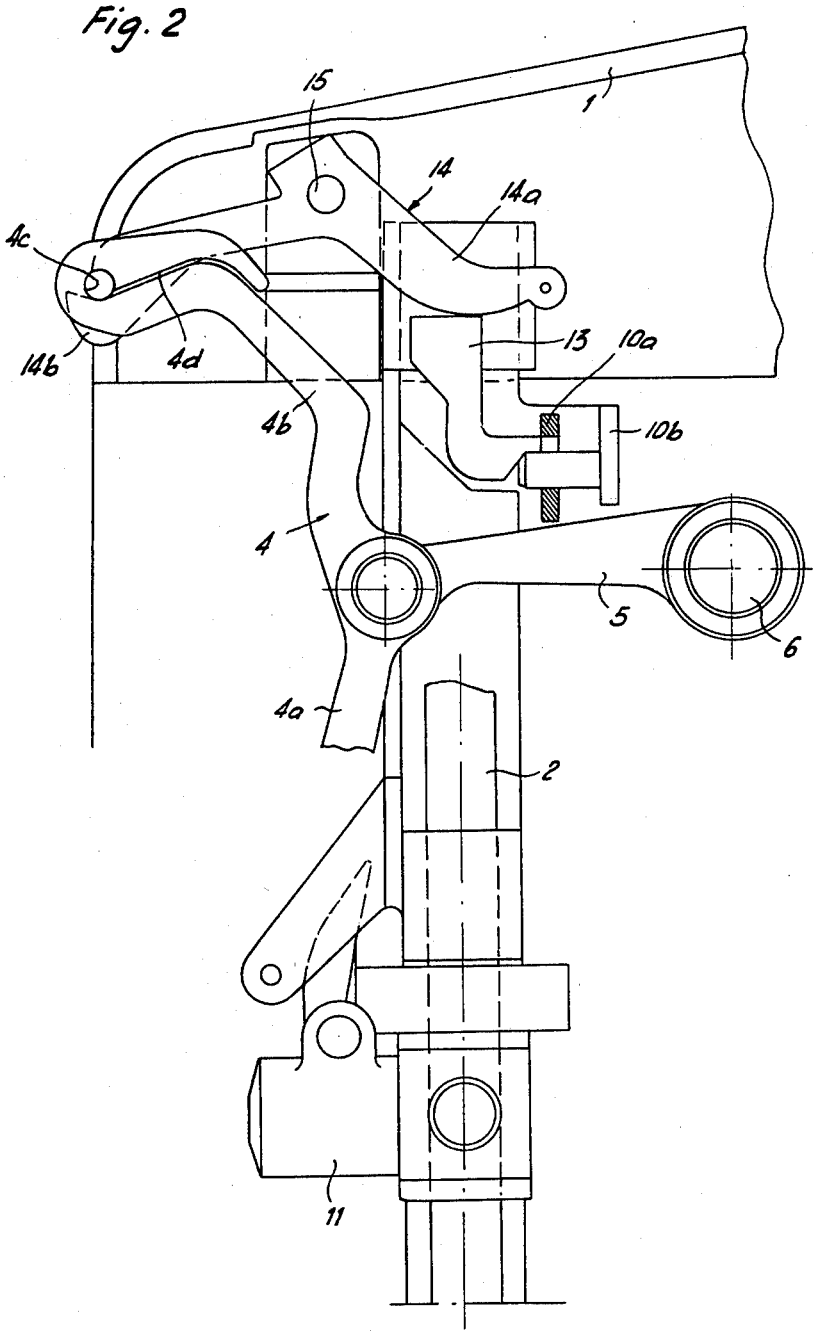
FIG. 2 shows a vertical section along line II—II of FIG. 1.

In the drawing the customary machine arm housing has the reference numeral 1. The drive apparatus, not shown in any more detail, and the skip stitch mechanism, as well as the guide device for the needle thread 3 are located in the head part of the housing. The machine parts which are of no specific importance in connection with the present invention are not described in any more detail hereinbelow. This applies as well to the skip stitch mechanism. The illustrated example of said mechanism corresponds with the detailed description in the Swiss patent application (G 6621/79) which corresponds to a companion U.S. application Ser. No. 167,102 filed July 9, 1980, now U.S. Pat. No. 4,359,954.

Figure 3:
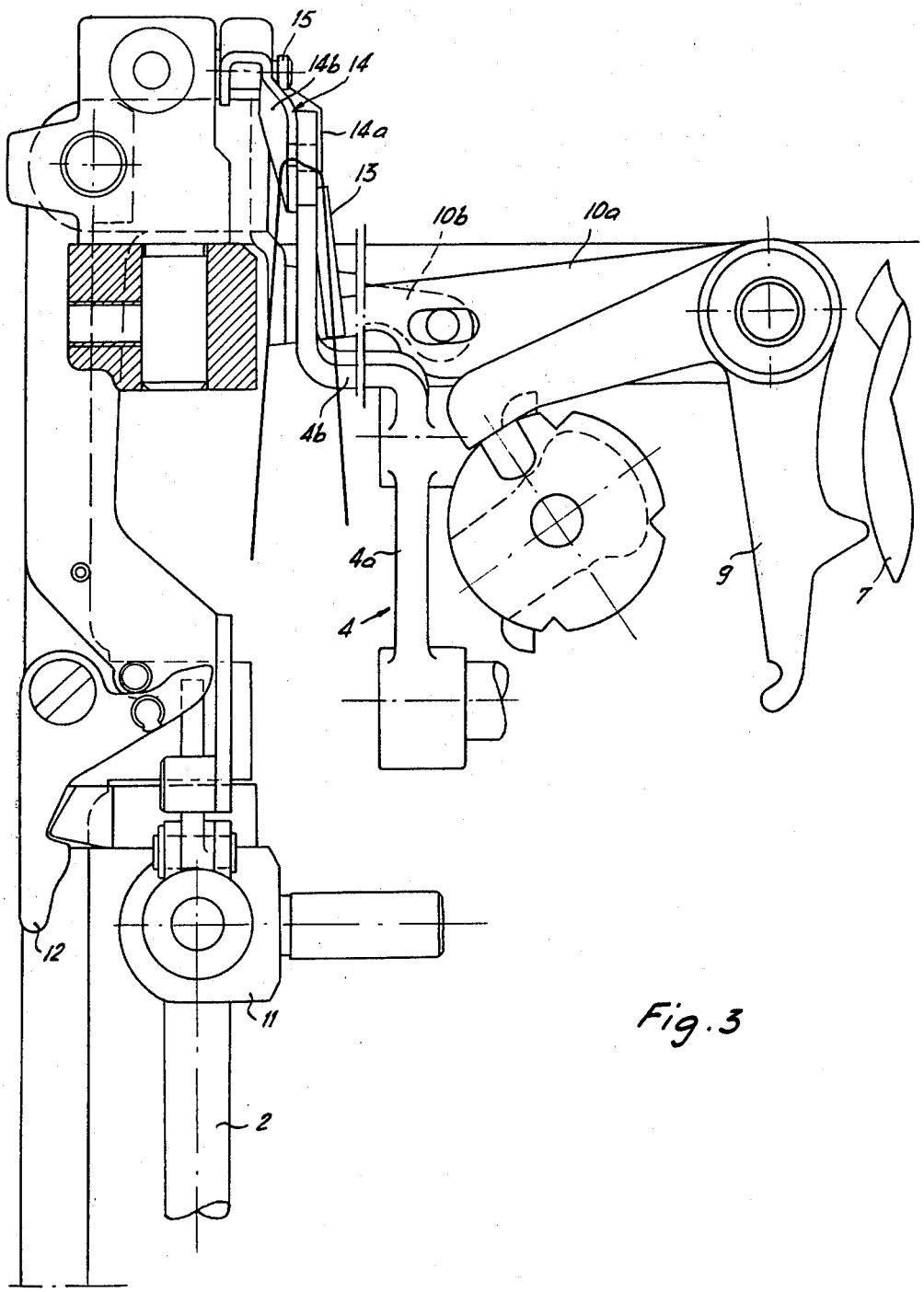
FIG. 3 shows a side view of FIG. 1 with the thread catcher hook eye in operating position aligned with the thread lever eye.
Figure 4:
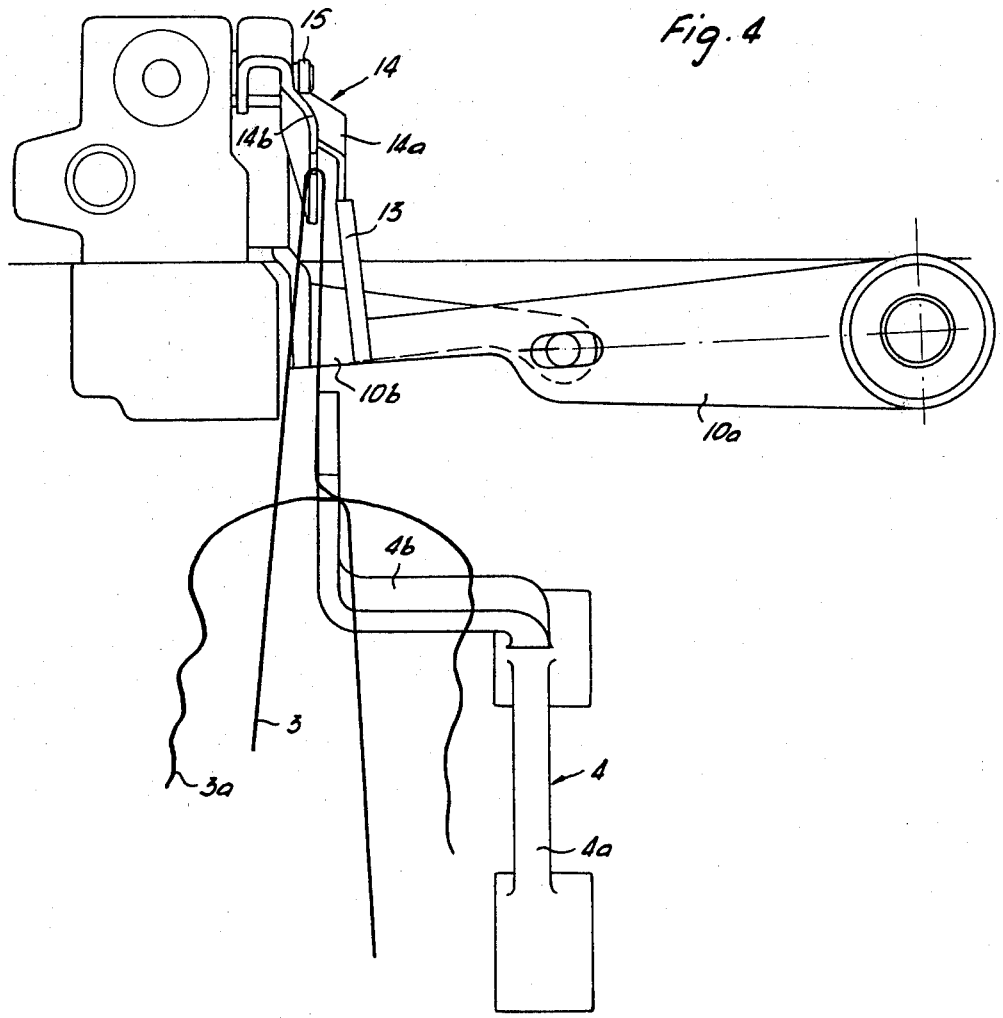
FIG. 4 shows a view according to FIG. 3 with the thread lever pivoted in the upward direction, and FIGS. 5, 6 and 7 each show a side view of the thread lever and the thread catcher illustrating various relative positions of the eyes of two levers.
Figure 6:
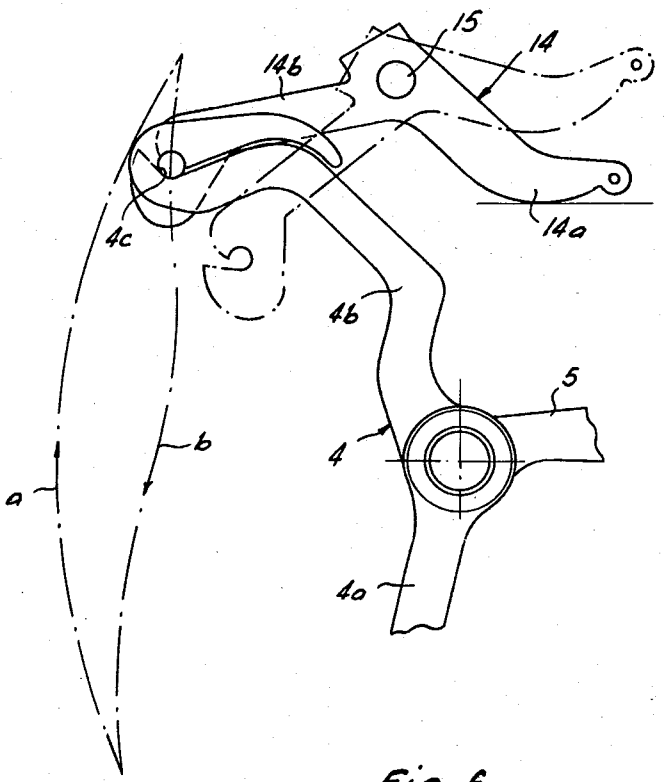
Figure 5:
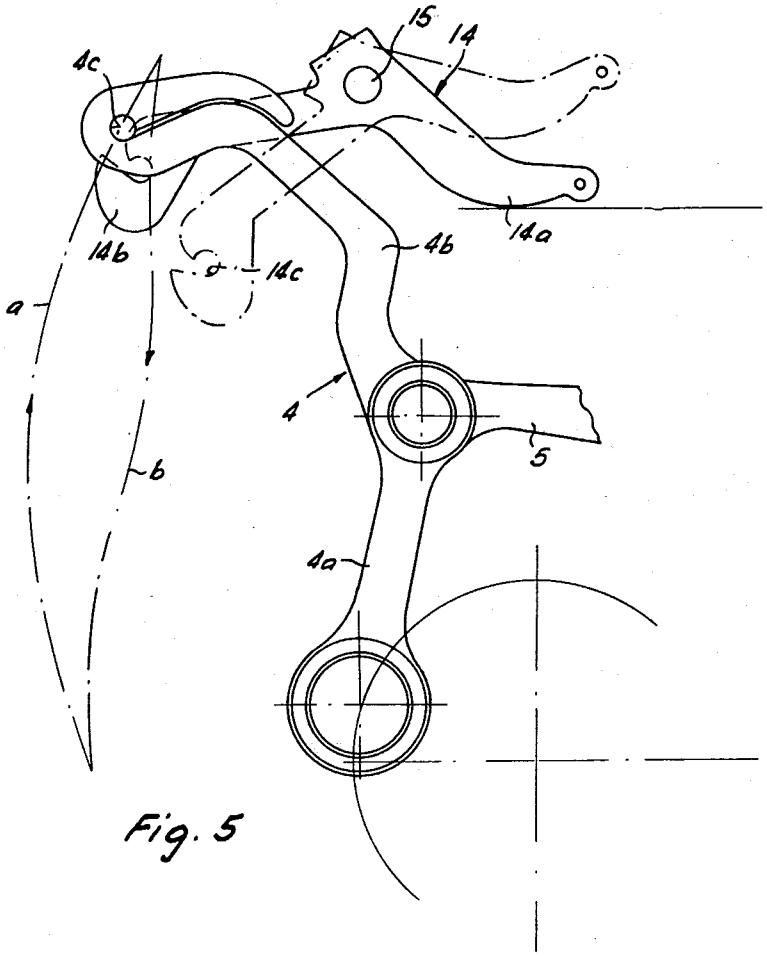
Figure 7:
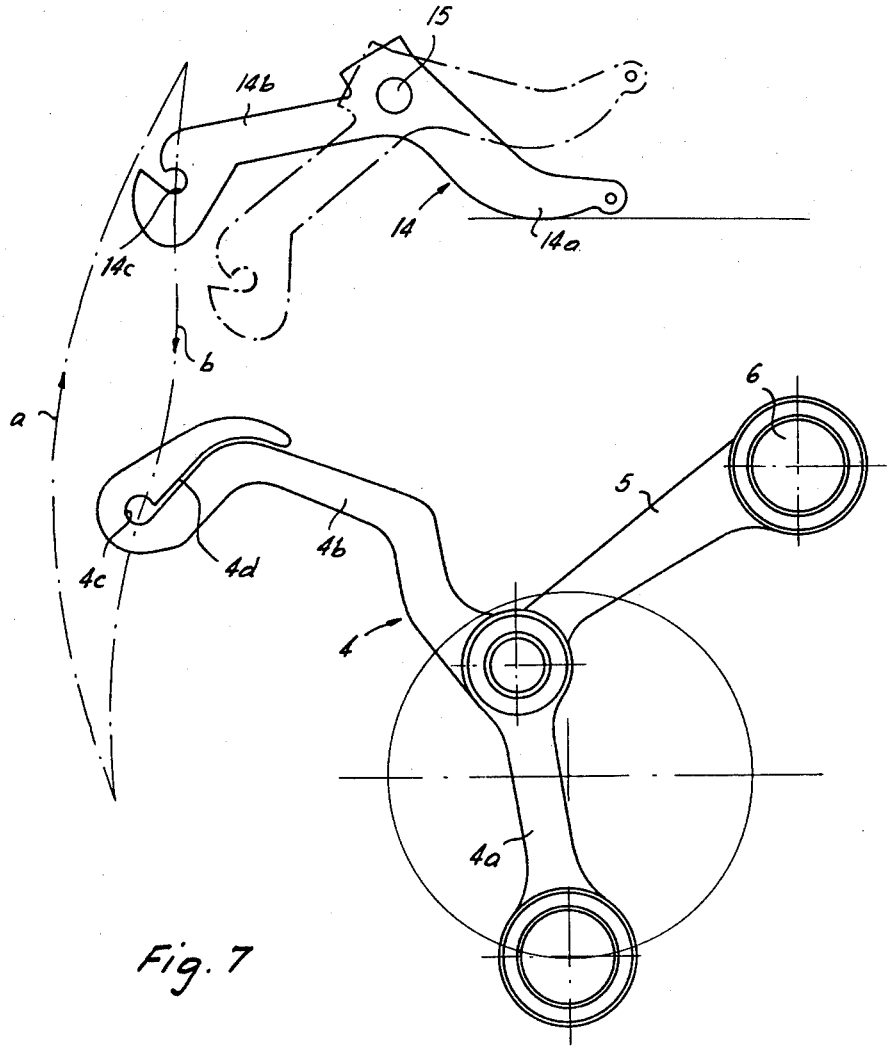

The thread guide device of the illustrated machine has a two-armed thread lever 4 which is attached to a connecting rod 5 which in turn is pivotingly attached to a stationary axis 6. The one arm 4*a* of the thread lever 4 is connected to a drive crank (not shown) while the other arm 4*b* has the customarily bent slot 4*d* which ends in a round eye 4*c* and is formed by the thread lever extension. The skip stitch mechanism found here, for example, has a program element in the form of a cam which determines the skip stitch intervals. A feeler lever 9 which is engaged and disengaged by hand through a button 8 follows the program element cam in operating position (FIG. 3). It either engages or disengages the carrier 11 for the needle shaft 2 by way of an appropriate lever mechanism 10*a*, 10*b* and simultaneously either engages or disengages a catch 12 which holds the needle shaft in its uppermost end position. Such a skip stitch mechanism, which is more closely described in the Swiss patent, is in its topmost end position in which the lever allows the needle shaft 2 to couple with its drive, while at the same time the extension arm 13 of lever 10*a* holds the thread catcher lever 14 against spring tension in the disengaged, pivoted position as shown with dotted lines in FIGS. 5, 6 and 7. The needle thread 3, carried along the eye 4*c* of the thread lever, is oscillatingly swung by the thread lever, which is driven synchronously with the needle shaft, for the purpose of supplying the lengths of thread needed to form stitches. The path covered by the thread lever eye 4*c* is designated, a, b in FIGS. 5, 6 and 7, and forms a self contained curve with an upper and lower reversal point. If the skip stitch is engaged by means of the button 8 the feeler lever 9 follows the program curve of the cam 7. If the feeler lobe of the feeler lever 9 is located on the radially higher part of the curve, this corresponds exactly to the aforementioned operating position of the individual elements for normal sewing, i.e. stitches are formed, and the thread catcher lever 14 is disengaged. On the one hand, if the feeler lobe of the feeler lever 9 moves onto the radially lower curve part, the needle shaft 2 is disconnected and stopped in its upper movement region by the catch 12 (FIG. 3) while, on the other hand, the thread catcher lever 14 is returned by spring tension to its operating position shown with solid lines in the drawing. In this position the eye 14*c* is aligned with one position of the upper portion of the upward reaching branch b of the movement path of thread lever eye 4*c*. After passing the upper reversal point, the thread eye 4*c*, carrying the needle thread 3, moves along down branch b of its movement path where the thread 3, carried along by it, is caught by the hook of the thread catcher lever 14 and held in the eye 14*c*, while the eye 4*c* of the thread lever moves further along down the extended thread portion. The length of thread pulled from the supply spool by the thread lever over the thread tensor, which is not pulled down by the needle due to the interruption of the stitch formation, remains stretched between the needle eye, the thread catcher eye 14*c*, the thread lever eye 4*c* and the thread tensor. Without this thread catcher, the thread loops between the thread tensor and the needle eye, caused by the thread lever 4 moving up and down, would oscillate between a slack and a taut condition (see 3*a* of FIG. 4). Such an uncontrolled oscillating of the thread loops is, as was stated above, avoided when the skip stitch mechanism is engaged by the thread catcher lever 14. The thread lever eye 4*c* which, after its downward movement, again follows the upward branch a of its movement path, lifts the needle thread 3 out of the hook of the thread catcher lever 14 again when it passes close by the eye 14*c* of the thread catcher 14 (FIG. 5). If the feeler lobe of the feeler lever 9 also remains on the lower part of the curve of the cam 7 for the next skip stitch cycle, i.e. the thread catcher lever 14 remains in its operating position, the needle thread 3 is hung again in the hook of the thread catcher lever 14 with the recurring upward movement of the thread lever, and the eye 4*c*, respectively. The thread loop is then drawn taut and held again. If, however, the feeler lever 9 has run onto the raised part of the curve on cam 7, this means not only that the needle shaft 2 is engaged and the catch 12 is disengaged, but also, by pushing the lever 14 up by means of the extension arm 13 of lever 10*a*, the thread catcher lever 14 is pivoted against spring tension simultaneously into its disengaged position. The result is that when the thread lever eye 4*c* goes down again, the needle thread passes unimpeded through the hook of the thread catcher lever 14. Normal stitch formation and consumption of fed-in excess thread results again when the needle shaft 2 goes down.

Of course the described thread catcher lever 14 associated with the thread lever 4*a*, *b*, *c* in no way anticipates the described skip stitch mechanism. The important point is that the thread catcher lever and the skip stitch mechanism are synchronously engaged and disengaged.

Thus, according to the present invention the needle thread guide device has an articulated thread lever 4, whose eye 4*c*, carrying the needle thread 3, follows a closed movement path a, b with an upper and lower reversal point. The skip stitch mechanism, which interrupts the stitch formation at intervals, is controlled by way of a lever mechanism 10*a*, 10*b* and a feeler lever 9 which can be engaged and disengaged by means of a cam 7. The cam controls a skip stitch mechanism which interrupts normal stitch formation at intervals by way of a lever mechanism and a feeler lever which can be engaged and disengaged. A lever 10*a* of the lever assembly 10*a*, 10*b* also simultaneously activates a thread catching lever 14. This rotates around a stationary axis in a plane parallel to the movement plane of the thread lever 4. In its operating position, which corresponds to the situation in which the skip stitch mechanism is engaged, a hook eye 14*c* of the thread catcher lever 14 is aligned with the upper part of the descending branch b of the movement path of the thread lever eye 4*c*. When the thread lever eye 4*c* goes down, the needle thread 3 is temporarily hung in the eye 14*c* of the thread catcher lever 14. The thread loop formed as the needle thread 3 continues to be pulled in when the thread is not used a result of the skipped stitch, is held taut preventing this loop from being moved around loosely by the thread lever's 4 up and down movement. By switching the skip stitch mechanism off, the thread catcher lever 14 is simultaneously disengaged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A needle thread guide device for use with a sewing machine provided with a skip stitch mechanism operating at intervals to form stitches of varying lengths comprising:

a thread feeder being operatively, articulated mounted to oscillate in a vertical plane;

drive means operatively connected to said thread feeder for imparting oscillating motion thereto;

a thread catcher operatively mounted adjacent to said thread feeder;

lever means operatively connected to said thread catcher for engaging and disengaging said thread catcher in synchronism with the skip stitch mechanism;

said thread feeder including a hook eye disposed at one end thereof;

oscillating means operatively connected to said thread feeder for moving said hook eye in an ascending path having an upper reversal point and a descending path;

said thread catcher including a hook eye being aligned in an operative position with the hook eye of said thread feeder at said upper reversal point of said ascending path for catching a thread loop being fed by said thread feeder.

2. The needle thread guide device according to claim 1, wherein the thread catcher is a two-armed lever which is pivotally disposed around a stationary axis, one of said arms being brought into its operating position by an activating lever of the skip stitch mechanism and the other of said arms being provided with said hook eye.

3. The needle thread guide device according to claim 2, wherein the thread catcher lifts the needle thread out of the thread feeder hook eye as it passes the thread feeder hook eye in the upward direction of the thread catcher while being pivoted into its operative position, and then hangs the needle thread in the thread feeder hook eye as it returns in the downward direction from the upper reversal point while the thread catcher is still in its operative position.

4. The needle thread guide device according to clam 3, wherein the lever means, which simultaneously activates the thread catcher lever and the skip stitch mechanism, is coupled with a feeler lever which can be engaged and disengaged by a cam which serves as a skip stitch program carrier.

5. A needle thread guide device according to claim 1, wherein said thread catcher maintains the needle thread in a taut condition during a skip stitch cycle.

6. A needle thread guide device according to claim 1, and further including an actuation button for selectively placing said skip stitch mechanism and said thread catcher in the operative or inoperative mode of operation.

7. A needle thread guide device according to claim 1, and further including a spring for biasing said thread catcher to a normal operating position and a lever for imparting movement to move said thread catcher from said operating position.

8. A needle thread guide device according to claim 1, wherein said drive means is a cam.

* * * * *

UNITED STATES PATENT AND TRADEMARK OFFICE

CERTIFICATE OF CORRECTION

PATENT NO. : 4,391,213

DATED : July 5, 1983

INVENTOR(S) : Ernst DREIER and Kurt SPRING

It is certified that error appears in the above—identified patent and that said Letters Patent is hereby corrected as shown below:

After "[22] Filed: Nov. 5, 1980" insert:

--[30] Foreign Application Priority Data
November 19, 1979 [CH] Switzerland.....G 10288/79--

Signed and Sealed this

Fourth Day of October 1983

[SEAL]

*Attest:*

GERALD J. MOSSINGHOFF

*Attesting Officer*

*Commissioner of Patents and Trademarks*